United States Patent [19]

Morrison

[11] 4,030,873

[45] June 21, 1977

[54] VIBRATING CONCRETE SCREED

[75] Inventor: Donald R. Morrison, Charlotte, N.C.

[73] Assignee: Lewis T. Morrison, Orange Park, Fla. ; a part interest

[22] Filed: Apr. 26, 1976

[21] Appl. No.: 680,116

[52] U.S. Cl. ..... 425/456; 259/DIG. 42; 404/114; 404/119; 425/218

[51] Int. Cl.[2] ..... B28B 1/08

[58] Field of Search ..... 425/218, 456; 404/114, 404/118, 119; 259/DIG. 42; 310/68 A

[56] References Cited

UNITED STATES PATENTS

| | | | |
|---|---|---|---|
| 1,119,387 | 12/1914 | Baker | 310/68 A |
| 1,943,076 | 1/1934 | Jackson | 259/DIG. 42 |
| 3,113,494 | 12/1963 | Barnes | 404/114 |
| 3,220,322 | 11/1965 | Lewis | 404/114 |
| 3,435,740 | 4/1969 | McGall | 404/119 |

*Primary Examiner*—Francis S. Husar
*Assistant Examiner*—John McQuade
*Attorney, Agent, or Firm*—Julian E. Carnes, Jr.

[57] ABSTRACT

A lightweight and portable vibrating screed is provided with an elongate open structure frame which may be made up of a plurality of interconnected frame units. A shaft is supported for rotation in spaced bearings along the frame and extends outwardly beyond the bearings at each end of the frame. Variable speed drive means is provided for rotating the shaft at a sufficient speed to cause deflection of the portions of the shaft between the bearings and the portions of the shaft extending outwardly beyond the bearings to impart uniform vibrations throughout the length of the screed.

8 Claims, 8 Drawing Figures

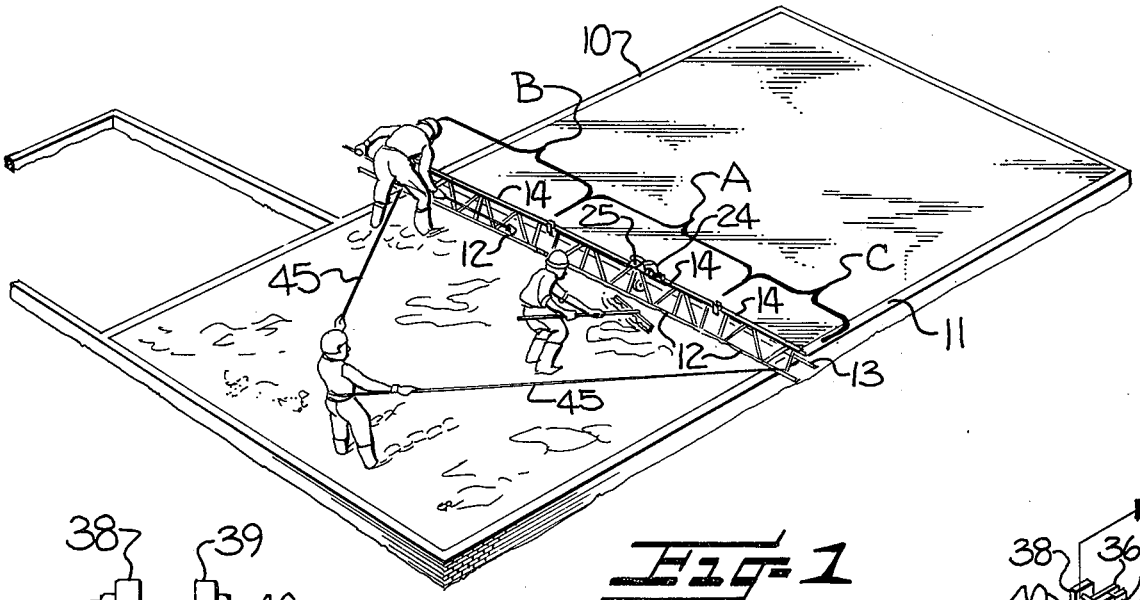
Fig-1
Fig-4
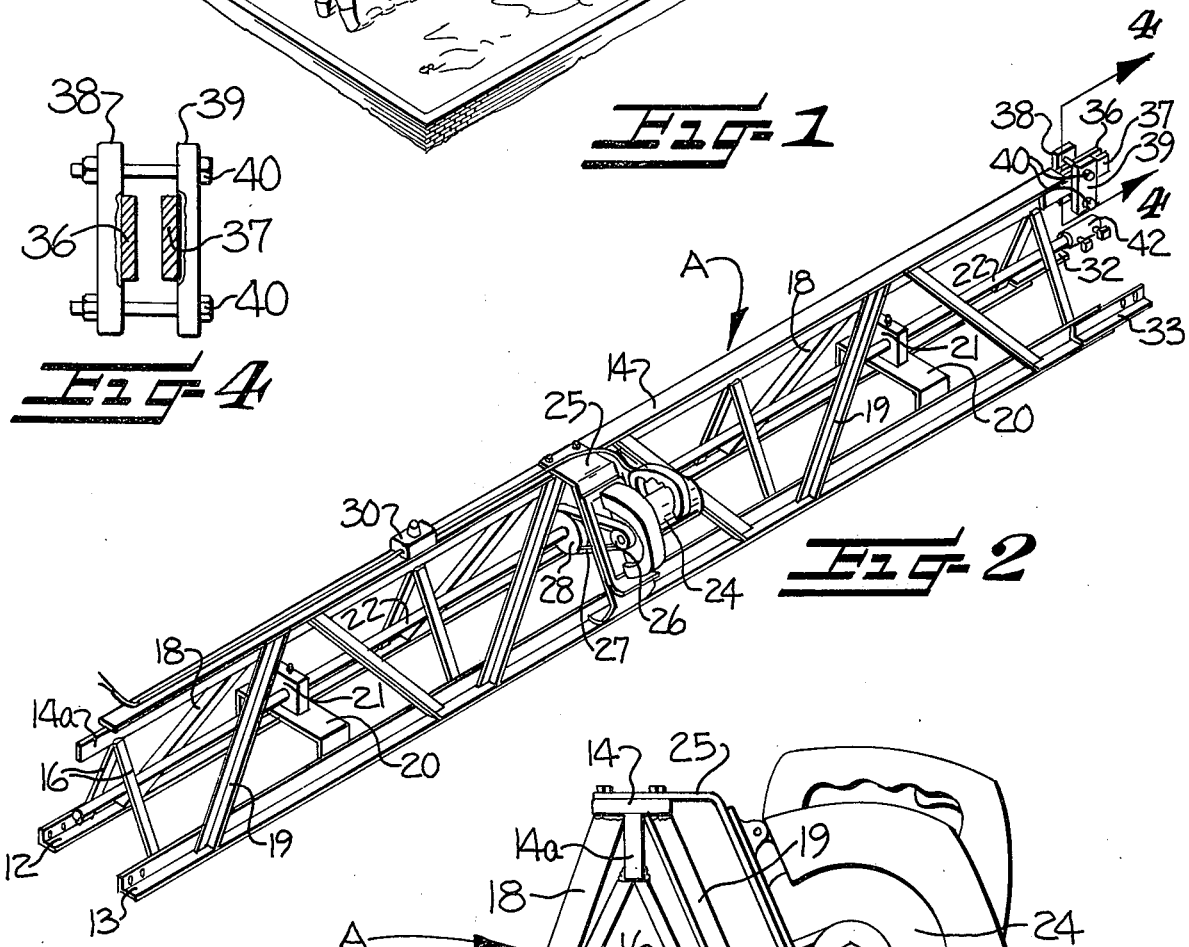
Fig-2
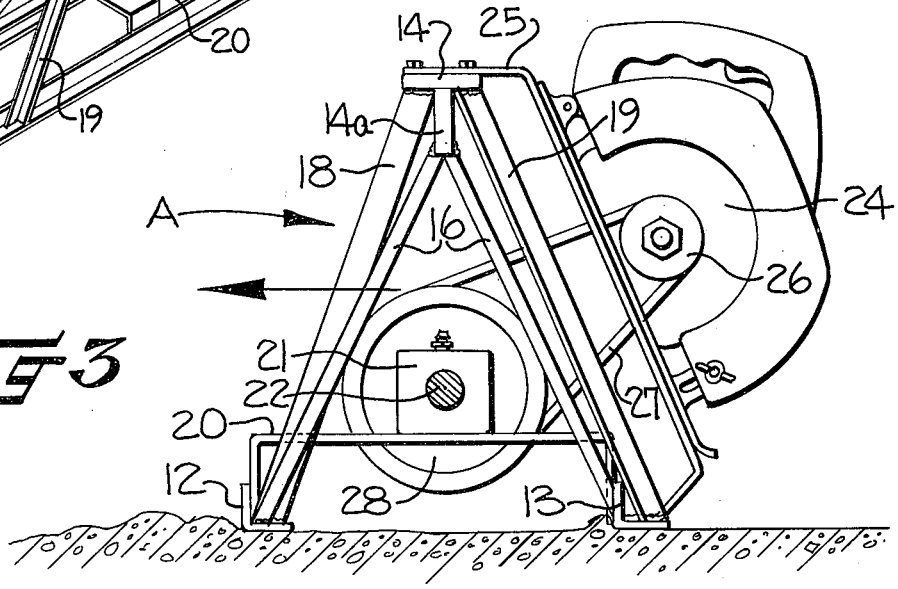
Fig-3

VIBRATING CONCRETE SCREED

This invention relates generally to lightweight and portable vibrating concrete screeds and more particularly to such a screed for applying uniform vibrations throughout the surface of the concrete in contact with the screed so that large areas of concrete are uniformly finished in a short period of time.

Various types of expensive pieces of heavy equipment have heretofore been employed in finishing concrete. However, these heavy finishing machines are difficult to use, costly to acquire, and difficult to move from one loaction to another. In an attempt to overcome the disadvantages of these heavy finishing machines, several types of relatively lightweight and less expensive vibrating concrete screeds have been proposed. These vibrating concrete screeds utilize different types of vibrating devices which are usually spaced along the length of the screed. However, the main force of the vibration is concentrated near the vibrating unit and is not uniformly spread along the length of the screed. Also, the vibration imparted to this type of screed has a tendency to be damped completely out or at least to be drastically reduced in those areas of the screed adjacent the points where the screed is supported on the concrete forms.

With the foregoing in mind, it is an object of the present invention to provide a vibrating concrete screed which is lightweight and portable, of a simple open structure frame construction and includes a rotating shaft extending throughout the length of the screed for imparting uniform vibrations throughout the length of the screed, including the endmost portions which are normally supported on form boards and the like.

In accordance with the present invention, the screed includes an elongate open structure frame which may be made up of individual frame units of varying or equal lengths. Means is provided for easily and quickly connecting together the individual frame units so that the surface of the concrete between forms may be finished in various configurations, such as flat, crowned, or with a valley therein. The open structure frame includes a pair of spaced apart screed plates adapted to engage and level the concrete as the screed is moved over the surface. Bearings are fixed on the frame and spaced inwardly from each end of the frame with a shaft supported for rotation in the bearings and extending throughout the length of the frame and beyond the bearings. Drive means is carried by the frame for rotating the shaft at a sufficient speed to cause deflection of the portions of the shaft between and beyond the bearings and to impart uniform vibrations throughout the length of each of the screed plates. Variable speed control means is provided for varying the speed of rotation of the shaft so as to vary the amount of vibration applied to the screed.

Other objects and advantages will appear as the description proceeds when taken in connection with the accompanying drawings, in which FIG. 1 is an isometric view of the present vibrating concrete screed being used in a typical concrete pouring and finishing project;

FIG. 2 is an enlarged isometric view of one individual frame unit of the vibrating concrete screed with the drive means for rotating the vibrating shaft mounted thereon;

FIG. 3 is an end view, at an enlarged scale and looking inwardly at the left-hand end of the screed unit shown in FIG. 2;

FIG. 4 is an enlarged vertical sectional view taken substantially along the line 4—4 in FIG. 2;

Figure 5:
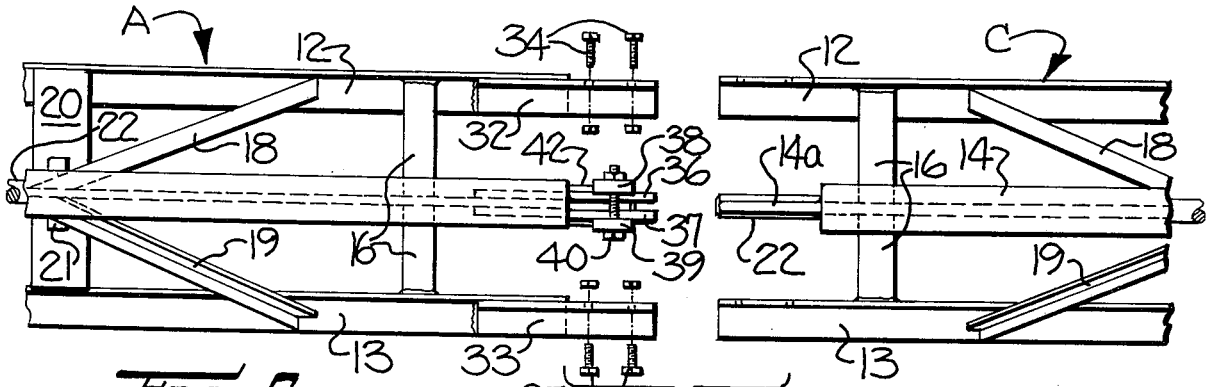
FIG. 5 is a fragmentary plan view of the right-hand end of the frame unit shown in FIG. 2 and illustrating the mating end of an adjacent frame unit in position to be assembled therewith.

As illustrated in FIG. 1, the screed is illustrated as being formed of three individual frame units, indicated by the brackets A, B, and C, connected together to form a sufficient length to extend between and be supported by the walls 10, 11 forming opposite sides of the form. The frame units A, B, and C can be of various lengths and can be easily and quickly connected together, in a manner to be presently described, so as to provide different lengths of creels for spanning forms of different widths. While it is to be understood that the individual frame units can vary in length, the frame units A and B are illustrated as being ten feet long each and the frame unit C as being five feet in length. It has also been found to be advantageous to provide short individual frame units of two and one-half feet in length. The individual frame units may be formed of any suitable material but are preferably formed of aluminum to reduce the weight.

The screed comprises an elongate open structure frame (FIGS. 2 and 3) including a pair of spaced apart screed plates 12, 13 which are illustrated as right angular members having vertical and horizontal legs each of which are one and three-quarter inches in width. The screed plates 12, 13 extend throughout the length of the screed and are adapted to engage and finish the concrete as the screed is moved over the concrete in the direction of the arrow in FIG. 3. While the open structure frame may take various configurations in cross-section, it is preferably in the form of an isosceles triangle with the screed plates 12, 13, forming the lower corners of the triangle and with a T-shaped ridge plate 14 forming the upper corner of the triangle.

The ridge plate 14 also extends throughout the length of the screed and is connected to the screed plates 12, 13 by suitable cross-braces. For example, vertical connector plates 16 are fixed at their lower ends in the screed plate 12 and at their upper ends to the T-shaped ridge plate 14. Spaced apart vertical connector plates 16 are also fixed at their lower ends to the screed plate 13 and at their upper ends to the ridge plate 14. Angularly disposed angle braces 18 are spaced along one side and their lower ends are connected to the screed plate 12 and their upper ends are fixed to the ridge plate 14. Similar angle braces 19 are spaced along the other side of the screed and their lower ends are fixed to the screed plate 13 while their upper ends are fixed to the ridge plate 14.

The screed plates 12, 13 are maintained in spaced apart relationship by bridging transverse bearing support plates 20 which are fixed at opposite ends to the screed plates 12, 13. Bearings 21 are fixed on the bridging plates 20 and are spaced inwardly from opposite ends of the frame. These bearings 20 are preferably block type bearings with suitable grease fittings for rotatably supporting a semiflexible shaft 22 for rotation therein. It is preferred that the shaft 22 by three-quarters inch in diameter and that the openings in the bearings block 21 be slightly larger to provide a loose fit and thereby permit vibration of the shaft as it is rotated, in a manner to be presently described. As illustrated in FIG. 2, the shaft 22 extends throughout the length of the frame and beyond the bearings 21, which are spaced inwardly from opposite ends of the frame.

Drive means is carried by the frame for rotating the shaft 22 at a sufficient speed to cause deflection or shipping of the portions of the shaft 22 between the bearings 21 and the portions of the shaft 22 extending beyond the bearings 21. Since the vibrating shaft 22 extends throughout the length of the screed, uniform vibrations are provided throughout the length of each of the screed plates 12, 13. The drive means is illustrated as an electric motor 24 of the type normally used to power a circular saw and which is suitably supported on a bracket 25 fixed on one side of the frame. A drive pulley 26 (FIG. 3) is fixed on the output shaft of the electric motor 24 and drives a V-belt 27 which in turn drives a larger drive pulley 28, fixed on the vibrating shaft 22. Variable speed control means is provided for varying the rotational speed of the shaft 22 to thereby vary the amount of vibration imparted to the screed. The variable speed control means is illustrated in FIG. 2 as a rheostat 30 which is interposed in the electric current supply line to the electric motor 24.

Each end of each frame unit of the concrete screed is provided with means for quickly and easily connecting it to an adjacent frame unit so that individual frame units of the desired length can be easily coupled together to increase or decrease the overall length of the concrete screed. To this end, the left-hand end of the frame unit shown in FIG. 2 is provided with enlarged holes in the vertical leg of the screed plates 12, 13 and the horizontal portion of the T-shaped ridge plate 14 is set back to leave a vertical portion extending outwardly therefrom to form a tongue 14*a*, for purposes to be presently described. The right-hand end of the frame unit shown in FIG. 2 is provided with angle extensions 32, 33 fixed at their inner ends to the respective screed plates 12, 13 and their outer ends extend outwardly therebeyond and are provided with enlarged holes to receive connecting bolts 34, 35, illustrated in exploded view in FIG. 5.

Adjustable connecting means is provided on the ridge plate 14 and includes a pair of plates 36, 37, the inner ends of which are suitably fixed to the vertical portion of the ridge plate 14. The outer ends of the plates 36, 37 extend outwardly to provide a groove for reception of the tongue 14*a* of the ridge plate 14 of an adjacent unit when the two units are connected together, in a manner to be presently described.

Figure 6:
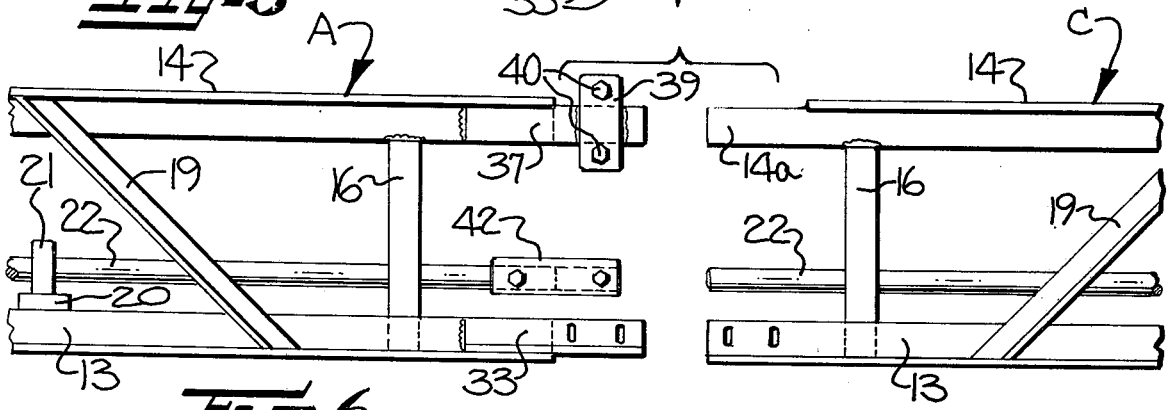
FIG. 6 is a view similar to FIG. 5 but showing the end portions of adjacent frame units in elevation.
Figure 7:
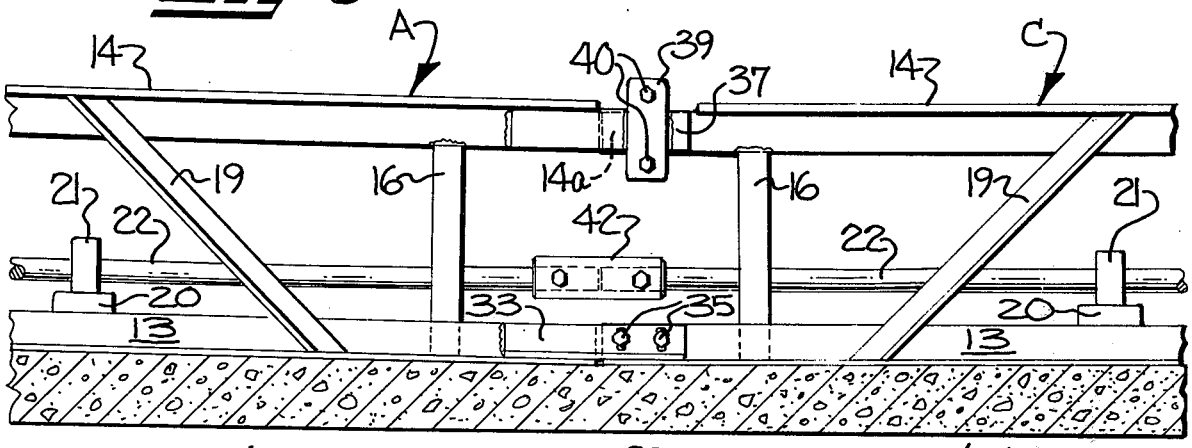
FIG. 7 is a view similar to FIG. 6 but showing the ends of adjacent frame units connected together and adjusted relative to each other to form a valley in the surface of the concrete.
Figure 8:
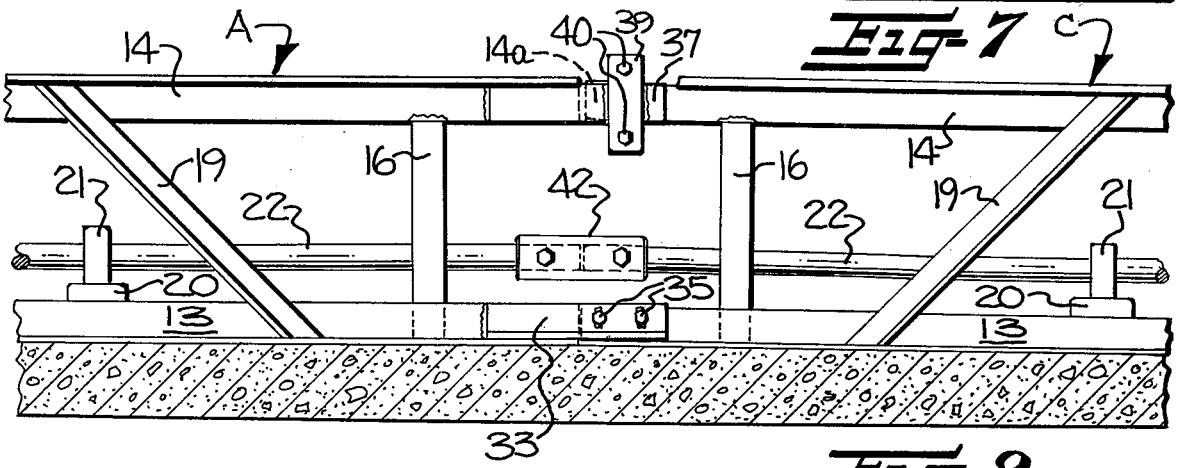
FIG. 8 is a view similar to FIG. 7 but showing the adjacent frame units connected together and adjusted relative to each other to form a crown in the surface of the concrete.

Clamp plates 38, 39 (FIG. 4) are fixed to the respective plates 36, 37 and are provided with clamping bolts 40. A coupling sleeve 42 is provided with lock nuts for drivingly connecting together adjacent ends of the shaft 22 of adjacent units when adjacent frame units are connected together. The tongue 14*a* of the ridge plate 14 at the left-hand end of one frame unit moves into the groove between the plates 36, 37 and the angle extensions 32, 33 overlap the left-hand end of the screed plates 12, 13 of the adjacent frame unit when the two ends of the unit are connected together, in a manner illustrated in FIG. 7. The connecting bolts 34, 35 extend through the enlarged holes and hold adjacent ends of the screed plates 12, 13 together while the clamping bolts 40 are tightened with the adjacent units in the desired angular relationship to each other, that is, straight as illustrated in FIG. 6, as illustrated in FIG. 7 to form a valley, or as illustrated in FIG. 8 to form a crown. The angular relationships shown in FIGS. 7 and 8 are somewhat exaggerated to more clearly illustrate the adjustment feature.

METHOD OF OPERATION

In order to finish concrete with the present vibrating concrete screed, one frame unit with a drive motor is used and as many additional frame units of the required length are coupled to the drive unit to span the distance between the concrete forms. The form area is then filled with concrete and the screed is positioned at one end of the form. The screed operator then moves the screed along the surface of the concrete, moving the screed direction illustrated in FIG. 3, by pulling a suitable rope 45 or the like, connected at opposite ends to opposite end portions of the screed while one or more workers fill in any low spots in the concrete in advance of the screed. The rotating and vibrating shaft 22 imparts uniform vibrations throughout the entire length of both the front and rear screed plates 12, 13. The front vibrating screed plate 12 is followed by the rear vibrating screed plate 13 to provide a proper finish to the surface of the concrete. The deflection or whipping of the shaft 22 provides sufficient uniform vibrations throughout the length of the screed that even those areas of the screed plates 12, 13 resting on the form walls 10, 11 are thoroughly vibrated. The concrete is vibrated to a sufficient degree to settle the concrete and prevent any voids or open areas in the concrete.

Thus, the present vibrating screed may be economically used to finish large areas of concrete in a short period of time. The screed may be easily moved from one site to another and the length may be easily varied to screed concrete areas of different widths.

If it is found that sufficient vibrations are not produced in the screed by varying the speed of the drive motor, the shaft 22 may be bent slightly to cause a greater deflection or whipping of the shaft. The portions of the shaft 22 extending outwardly beyond the bearings 21 may be bent or the portion of the shaft between the bearings 21 may also be bent.

In the drawings and specification there has been set forth a preferred embodiment of the invention, and although specific terms ar employed, they are used in a generic and descriptive sense only and not for purposes of limitation.

I claim:

1. A vibrating concrete screed comprising a. an elongate open structure frame including a pair of spaced apart screed plates adapted to engage and level concrete as said screed is moved over the concrete, b. bearings fixed on said frame and spaced inwardly from each end of said frame, c. a vibrating element consisting of a semiflexible shaft loosely supported for rotation in said bearings and extending throughout the length of said frame and beyond said bearings spaced inwardly from each end of said frame, and d. drive means carried by said frame for rotating said shaft at a sufficient speed to cause deflection of the portions of said shaft between and beyond said bearings and to impart uniform vibrations throughout the lengths of each of said screed plates.

2. A vibrating concrete screed according to claim 1 including e. variable speed control means associated with said drive means (d) for varying the rotational speed of said shaft to thereby vary the vibrations imparted to said screed plates.

3. A vibrating concrete screed according to claim 1 wherein said drive means (d) comprises an electric motor fixed on said frame, and means drivingly connecting said electric motor to said shaft.

4. A vibrating concrete screed according to claim 3 wherein said means drivingly connecting said electric motor to said shaft comprises a drive pulley on said electric motor, a drive pulley on said shaft, and a V-belt drivingly connecting said pulleys.

5. A vibrating concrete screed according to claim 2 wherein said drive means (d) comprises an electric motor drivingly connected to said shaft, and wherein said variable speed control means (e) comprises a rheostat for controlling the speed of said electric motor and to thereby vary the rotational speed of said shaft to vary the vibrations imparted to said screed plates.

6. A vibrating concrete screed according to claim 1 wherein said elongate open structure frame comprises at least a pair of separable frame units each having its own shaft and screed plates, bearings fixed on each of said frame units and spaced inwardly from each end of each of said frame units, the shafts supported for rotation in said bearings of each frame unit and extending throughout the length of each of said frame units and beyond said bearings spaced inwardly from each end of each of said frame units, and including means removably connecting together adjacent end portions of adjacent frame units in fixed relationship to each other, and means drivingly connecting together adjacent end portions of said shafts of adjacent frame units.

7. A vibrating concrete screed according to claim 6 wherein said means removably connecting together adjacent end portions of adjacent frame units includes adjustment means for varying the angular relationship between the screed plates of one frame unit relative to the screed plates of the adjacent frame unit.

8. A vibrating concrete screed according to claim 1 wherein said elongate open structure frame (a) is in the form of an isosceles triangle in cross-section, said screed plates being positioned at the lower corners of said triangle, said frame including a ridge plate positioned at the upper corner of said triangle, and including cross-braces fixed to and extending between said screed plates and said ridge plate.

* * * * *